US008864532B2

(12) United States Patent
Larsen et al.

(10) Patent No.: US 8,864,532 B2
(45) Date of Patent: Oct. 21, 2014

(54) COMMUNICATIONS JACKS HAVING LOW CROSSTALK AND/OR SOLDER-LESS WIRE CONNECTION ASSEMBLIES

(71) Applicant: CommScope, Inc. of North Carolina, Hickory, NC (US)

(72) Inventors: Wayne D. Larsen, Wylie, TX (US); Amid I. Hashim, Plano, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 68 days.

(21) Appl. No.: 13/835,240

(22) Filed: Mar. 15, 2013

(65) Prior Publication Data

US 2014/0273639 A1 Sep. 18, 2014

(51) Int. Cl.
*H01R 24/00* (2011.01)
*H01R 13/719* (2011.01)

(52) U.S. Cl.
CPC ..... *H01R 13/719* (2013.01); *H01R 23/005* (2013.01); *Y10S 439/941* (2013.01)
USPC ..... 439/676; 439/941; 439/499

(58) Field of Classification Search
USPC ..... 439/676, 941, 67, 77, 499, 492
See application file for complete search history.

(56) References Cited

U.S. PATENT DOCUMENTS

| | | | | |
|---|---|---|---|---|
| 6,428,362 | B1 | 8/2002 | Phommachanh | |
| 7,179,131 | B2 | 2/2007 | Caveney et al. | |
| 7,364,470 | B2 * | 4/2008 | Hashim | 439/676 |
| 7,442,092 | B2 | 10/2008 | Caveney et al. | |
| 7,604,515 | B2 | 10/2009 | Siemon et al. | |
| 7,670,193 | B2 | 3/2010 | Milette et al. | |
| 7,824,231 | B2 | 11/2010 | Marti et al. | |
| 7,837,513 | B2 | 11/2010 | Millette et al. | |
| 7,857,635 | B2 | 12/2010 | Goodrich et al. | |
| 7,976,348 | B2 | 7/2011 | Aekins et al. | |
| 7,980,899 | B2 | 7/2011 | Siemon et al. | |
| 7,980,900 | B2 * | 7/2011 | Hashim et al. | 439/676 |
| 8,235,731 | B1 | 8/2012 | Poulsen et al. | |
| 2003/0232517 | A1 | 12/2003 | Liu et al. | |
| 2007/0178772 | A1 * | 8/2007 | Hashim et al. | 439/676 |
| 2010/0124855 | A1 | 5/2010 | Milette et al. | |
| 2011/0065322 | A1 | 3/2011 | Milette et al. | |
| 2011/0124219 | A1 | 5/2011 | Milette et al. | |
| 2012/0040539 | A1 | 2/2012 | Enge et al. | |
| 2012/0100744 | A1 | 4/2012 | Bolouri-Saransar et al. | |

(Continued)

FOREIGN PATENT DOCUMENTS

GB 2347025 A 8/2000

OTHER PUBLICATIONS

Combined Search and Examination Report, corresponding to Great Britain Application No. GB1404216.2, dated Aug. 15, 2014, 3 pages.

*Primary Examiner* — Gary Paumen
(74) *Attorney, Agent, or Firm* — Myers Bigel Sibley & Sajovec, P.A.

(57) ABSTRACT

Communications jacks include a housing having a plug aperture, a plurality of input contacts, a plurality of output contacts, and a flexible printed circuit board that includes a plurality of conductive pads and a plurality of conductive paths that each electrically connect a respective one of the input contacts to a respective one of the conductive pads. The conductive paths are arranged as a plurality of differential pairs of conductive paths, and each output contact includes a spring-biased base and an insulation displacement portion.

21 Claims, 9 Drawing Sheets

(56) References Cited

U.S. PATENT DOCUMENTS

2012/0156932 A1 6/2012 Straka et al.
2013/0225009 A1* 8/2013 Hashim et al. ..... 439/676
2014/0073196 A1* 3/2014 Hashim et al. ..... 439/676
2014/0073197 A1* 3/2014 Fitzpatrick ..... 439/676

* cited by examiner

COMMUNICATIONS JACKS HAVING LOW CROSSTALK AND/OR SOLDER-LESS WIRE CONNECTION ASSEMBLIES

FIELD OF THE INVENTION

The present invention relates generally to communications jacks and, more particularly, to wire connection assemblies for communications jacks.

BACKGROUND

Computers, fax machines, printers and other electronic devices are routinely connected by communications cables to network equipment such as routers, switches, servers and the like. FIG. 1 illustrates the manner in which a computer 10 may be connected to a network device 30 (e.g., a network switch) using conventional communications plug/jack connections. As shown in FIG. 1, the computer 10 is connected by a patch cord 11 to a communications jack 20 that is mounted in a wall plate 18. The patch cord 11 comprises a communications cable 12 that contains a plurality of individual conductors (e.g., eight insulated copper wires) and first and second communications plugs 13, 14 that are attached to the respective ends of the cable 12. The first communications plug 13 is inserted into a plug aperture of a communications jack (not shown) that is provided in the computer 10, and the second communications plug 14 is inserted into a plug aperture 22 in the front side of the communications jack 20. The contacts or "blades" of the second communications plug 14 are exposed through the slots 15 on the top and front surfaces of the second communications plug 14 and mate with respective "jackwire" contacts of the communications jack 20. The blades of the first communications plug 13 similarly mate with respective jackwire contacts of the communications jack (not shown) that is provided in the computer 10.

The communications jack 20 includes a wire connection assembly 24 that receives and holds insulated conductors from a cable 26. As shown in FIG. 1, each conductor of cable 26 is individually pressed into a respective one of a plurality of slots provided in the wire connection assembly 24 to establish mechanical and electrical connection between each conductor of cable 26 and a respective one of a plurality of conductive paths (not shown in FIG. 1) through the communications jack 20. The other end of each conductor in cable 26 may be connected to, for example, the network device 30. The wall plate 18 is typically mounted on a wall (not shown) of a room of, for example, an office building, and the cable 26 typically runs through conduits in the walls and/or ceilings of the office building to a room in which the network device 30 is located. The patch cord 11, the communications jack 20 and the cable 26 provide a plurality of signal transmission paths over which information signals may be communicated between the computer 10 and the network device 30. It will be appreciated that typically one or more patch panels, along with additional communications cabling, would be included in the communications path between the cable 26 and the network device 30. However, for ease of description, in FIG. 1 the cable 26 is shown as being directly connected to the network device 30.

In the above-described communications system, the information signals that are transmitted between the computer 10 and the network device 30 are typically transmitted over a pair of conductors (hereinafter a "differential pair" or simply a "pair") rather than over a single conductor. An information signal is transmitted over a differential pair by transmitting signals on each conductor of the pair that have equal magnitudes, but opposite phases, where the signals transmitted on the two conductors of the pair are selected such that the information signal is the voltage difference between the two transmitted signals. The use of differential signaling can greatly reduce the impact of noise on the information signal.

Various industry standards, such as the TIA/EIA-568-B.2-1 standard approved Jun. 20, 2002 by the Telecommunications Industry Association, have been promulgated that specify configurations, interfaces, performance levels and the like that help ensure that jacks, plugs and cables that are produced by different manufacturers will all work together. By way of example, the TIA/EIA-568-C.2 standard (August 2009) is designed to ensure that plugs, jacks and cable segments that comply with the standard will provide certain minimum levels of performance for signals transmitted at frequencies of up to 500 MHz. Most of these industry standards specify that each jack, plug and cable segment in a communications system must include eight conductors 1-8 that are arranged as four differential pairs of conductors. The industry standards specify that, in at least the connection region where the contacts (blades) of a plug mate with the jackwire contacts of the jack (referred to herein as the "plug-jack mating region"), the eight contacts in the plug are generally aligned in a row, as are the corresponding eight contacts in the jack. As shown in FIG. 2, which schematically illustrates the positions of the jackwire contacts of a jack in the plug-jack mating region, under the widely used TIA/EIA 568 type B configuration, in which conductors 4 and 5 comprise differential pair 1, conductors 1 and 2 comprise differential pair 2, conductors 3 and 6 comprise differential pair 3, and conductors 7 and 8 comprise differential pair 4.

Unfortunately, the industry-standardized configuration for the plug-jack mating region that is shown in FIG. 2, which was adopted many years ago, generates a type of noise known as "crosstalk." "Crosstalk" refers to unwanted signal energy that is induced onto the conductors of a first "victim" differential pair from a signal that is transmitted over a second "disturbing" differential pair. The induced crosstalk may include both near-end crosstalk (NEXT), which is the crosstalk measured at an input location corresponding to a source at the same location (i.e., crosstalk whose induced voltage signal travels in an opposite direction to that of an originating, disturbing signal in a different path), and far-end crosstalk (FEXT), which is the crosstalk measured at the output location corresponding to a source at the input location (i.e., crosstalk whose signal travels in the same direction as the disturbing signal in the different path). Both types of crosstalk comprise an undesirable noise signal that interferes with the information signal on the victim differential pair.

Various techniques have been developed for cancelling out the crosstalk that arises in industry standardized plugs and jacks. Many of these techniques involve providing crosstalk compensation circuits in each communications jack that introduce "compensating" crosstalk that cancels out much of the "offending" crosstalk that is introduced in the plug and the plug-jack mating region due to the industry-standardized plug-jack interface. In order to achieve high levels of crosstalk cancellation, the industry standards specify small, pre-defined ranges for the crosstalk that is injected between the four differential pairs in each communication plug, which allows each manufacturer to design the crosstalk compensation circuits in their communications jacks to cancel out these pre-defined amounts of crosstalk.

Most high performance communications jacks that are in use today employ "multi-stage" crosstalk compensation circuits such as the crosstalk compensation schemes disclosed in U.S. Pat. No. 5,997,358 to Adriaenssens et al. With multistage crosstalk compensation, a first stage of "compensating" crosstalk may be provided (which has a polarity that is opposite the polarity of the offending crosstalk) that not only compensates for the offending crosstalk, but in fact overcompensates. Then, a second stage of compensating crosstalk is provided that has the same polarity as the offending crosstalk that cancels out the overcompensating portion of the first stage of compensating crosstalk. As explained in the '358 patent, the entire content of which is hereby incorporated herein by reference as if set forth fully herein, these multistage compensating schemes can theoretically completely cancel an offending crosstalk signal at a specific frequency and can provide significantly improved crosstalk cancellation over a range of frequencies.

SUMMARY

Pursuant to embodiments of the present invention, RJ-45 communications jacks are provided that have eight jackwire contact having plug contact regions that are aligned in numerical order across the plug aperture, a printed circuit board, and eight output contacts that intercept the printed circuit board at a first through eighth respective intercepts. The printed circuit board has a front edge, a back edge and two side edges. Eight conductive paths are provided on the printed circuit board that connect the first through eighth input contacts to the respective first through eighth intercepts, the conductive paths being arranged as four differential pairs of conductive paths according to the TIA/EIA 568 type B configuration. In these jacks, the second differential pair of output contacts is positioned along the first side edge and the fourth differential pair of output contacts is positioned along the second side edge, generally opposite the second differential pair of output contacts. The first differential pair of output contacts is positioned forward of the second and fourth differential pairs of output contacts, and the third differential pair of output contacts is positioned generally opposite the first differential pair of output contacts forward of the second and fourth differential pairs of output contacts. Moreover, the first differential pair of output contacts is closer to the third differential pair of output contacts than the second differential pair of output contacts is to the fourth differential pair of output contacts.

In some embodiments, the first and second conductive paths may pass between both the first and third differential pairs of output contacts and the first side edge of the printed circuit board, and/or the seventh and eighth conductive paths may pass between both the first and third differential pairs of output contacts and the second side edge of the printed circuit board. The printed circuit board may be a flexible printed circuit board, and the output contacts may be insulation displacement contacts. The first and second conductive paths may avoid crossing over any of the fourth through eighth conductive paths, and/or the seventh and eighth conductive paths may avoid crossing over any of the first through fifth conductive paths. In other embodiments, the first and second conductive paths may also avoid crossing over the third conductive path, or the seventh and eighth conductive paths may also avoid crossing over the sixth conductive path. In some embodiments, at most only one of the first through eighth conductive paths crosses over a conductive path of a different differential pair of conductive paths.

In some embodiments, a first straight line may connect the third intercept to the sixth intercept and a second straight line may connect the fourth intercept to the fifth intercept. These first and second lines may cross at an intersection point that lies between the third and sixth intercepts and between the fourth and fifth intercepts. In some embodiments, this intersection point may be equidistant to the third and sixth intercepts and also may be equidistant to the fourth and fifth intercepts. This may provide a jack having output contacts for pairs 1 and 3 that are neutral in terms of crosstalk generation therebetween. In some embodiments, the third and sixth output contacts may extend from a first surface of the printed circuit board and the fourth and fifth output contacts may extend from a second surface of the printed circuit board that is opposite to the first surface.

In some embodiments, the first, second, seventh and eighth conductive paths may be longer than each of the third through sixth conductive paths. At least two of the insulation displacement contacts may extend upwardly from a top surface of the printed circuit board, and at least two of the insulation displacement contacts may extend downwardly from a bottom surface of the printed circuit board. The flexible printed circuit board may include a fold that is positioned between the second and fourth differential pairs of output contacts and the first and third differential pairs of output contacts.

Pursuant to embodiments of the present invention, RJ-45 communications jacks are provided that have eight jackwire contact having plug contact regions that are aligned in numerical order across the plug aperture and eight output contacts. These jacks further include a printed circuit board that has a front edge, a back edge and two side edges. Eight conductive paths are provided on the printed circuit board that connect the first through eighth input contacts to the respective first through eighth output contacts, the conductive paths being arranged as four differential pairs of conductive paths according to the TIA/EIA 568 type B configuration. In these jacks, at least one of the differential pairs of output contacts extend upwardly from a top surface of the printed circuit board, and at least one other of the differential pairs of output contacts extend downwardly from a bottom surface of the printed circuit board.

In some embodiments, the first through eighth output contacts may be insulation displacement contacts. The first differential pair of output contacts and the third differential pair of output contacts may extend in opposite directions from the printed circuit board. The printed circuit board may be a flexible printed circuit board. The four differential pairs of output contacts may be arranged in substantially a parallelogram arrangement. The first output contact of one of the differential pairs of output contacts may extend from the top surface of the printed circuit board and the second output contact of the one of the differential pairs of output contacts may extend from the bottom surface of the printed circuit board.

Pursuant to embodiments of the present invention, communications jacks are provided that have a plurality of input contacts, a plurality of output contacts that are arranged as a plurality of differential pairs of output contacts, and a flexible printed circuit board that includes a plurality of conductive paths that each electrically connect a respective one of the input contacts to a respective one of the output contacts, the conductive paths being arranged as a plurality of differential pairs of conductive paths. The flexible printed circuit board includes a fold of at least about 30 degrees, and two of the differential pairs of output contacts are on a first side of the fold and two other of the differential pairs of output contacts are on the second side of the fold.

In some embodiments, the communications jack is an RJ-45 communications jack. The fold may be between 60 and 120 degrees.

Pursuant to embodiments of the present invention, communications connectors are provided that include a plurality of input contacts, a plurality of insulation displacement contacts, and a flexible printed circuit board that includes a plurality of conductive paths that each electrically connect a respective one of the input contacts to a respective one of the insulation displacement contacts, the conductive paths being arranged as a plurality of differential pairs of conductive paths. A mounting substrate is provided under the flexible printed circuit board that includes a plurality of apertures. Each insulation displacement contact includes a base that is mounted through a respective one of a plurality of conductive vias in the flexible printed circuit and into a respective one of the apertures in the mounting substrate, an insulation displacement portion and an expanding central portion that is between the base and the insulation displacement portion. The central portion on each insulation displacement contact is configured to expand outwardly to firmly contact a conductive structure of the flexible printed circuit board in response to insertion of the base into its respective aperture in the mounting substrate.

In some embodiments, the insulation displacement portion of each output contact may be an insulation displacement contact structure, and the communications connector may be an RJ-45 jack. A pair of tines that bow outwardly in different directions may at least partly form the base and the expanding central portion. The flexible printed circuit board may rest directly on the substrate, and the central portion of each insulation displacement contact may be configured to engage the inner sidewall of a respective one of a plurality of conductive vias in the flexible printed circuit board. Each insulation displacement contact may be electrically connected to the flexible printed circuit board through a solder-less connection.

Pursuant to embodiments of the present invention, communications jacks are provided that include a housing having a plug aperture, a plurality of input contacts, a plurality of output contacts and a flexible printed circuit board that has a plurality of conductive pads and a plurality of conductive paths that each electrically connect a respective one of the input contacts to a respective one of the conductive pads, the conductive paths being arranged as a plurality of differential pairs of conductive paths. Each output contact includes a spring-biased base and an insulation displacement portion.

In some embodiments, the base may be disposed at an angle of at least 30 degrees from the insulation displacement portion, and the base may be disposed between the housing and a respective one of the conductive pads. The base may be formed of a resilient metal, and the housing may press the base of each output contact against its respective conductive pad on the flexible printed circuit board.

Pursuant to embodiments of the present invention, communications jacks are provided that include a flexible printed circuit board and a plurality of output contacts. Each output contact includes an insulation displacement termination that extends through the flexible printed circuit board and that electrically connects the respective output contact to respective ones of a plurality of conductive paths on the flexible printed circuit board.

DETAILED DESCRIPTION

Pursuant to embodiments of the present invention, communications jacks are provided that have improved output contacts that may exhibit low levels of crosstalk and/or which may be used to provide solder-less connections to a printed circuit board. The output contacts according to embodiments of the present invention may be used with communications jacks that include any type of printed circuit board, but may be particularly appropriate for use with communications jacks that include flexible printed circuit boards as, in some embodiments, the output contacts disclosed herein may eliminate any need to solder the output contacts to the flexible printed circuit board.

Figure 1:
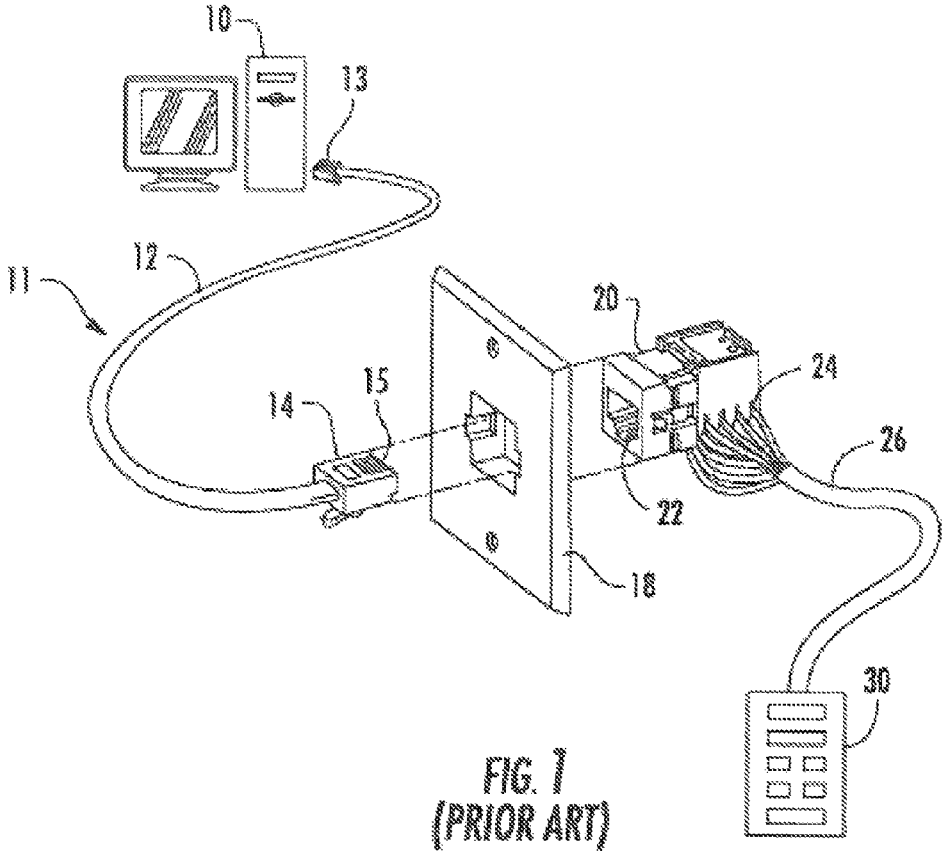
FIG. 1 (PRIOR ART)
FIG. 1 is a schematic drawing that illustrates the use of communications plug and jack connectors to connect a computer to a network device.
Figure 2:
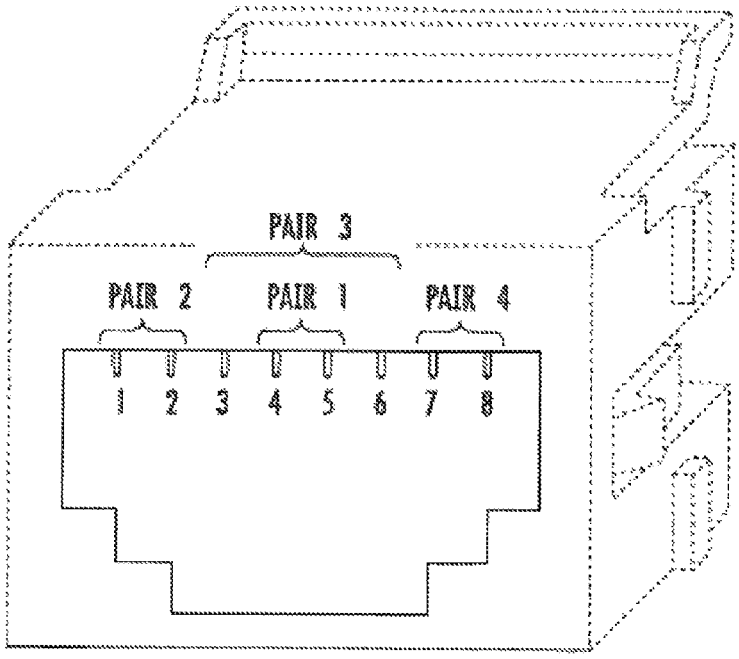
FIG. 2 (PRIOR ART)
FIG. 2 is a schematic diagram illustrating the TIA 568 type B modular jack contact wiring assignments for a conventional 8-position communications jack as viewed from the front opening of the jack.

In some embodiments, the communications jacks may be RJ-45 jacks that have eight insulation displacement contacts ("IDCs") that are arranged as four pairs of IDCs consistent with the TIA/EIA 568 type B configuration discussed above with reference to FIG. 2. The IDCs may be mounted on a printed circuit board which has jackwire contacts that extend toward the front of the printed circuit board. The IDCs for pairs 2 and 4 may be positioned towards the back of the printed circuit board, with pair 2 on one side of the printed circuit board and pair 4 on the other side. The IDCs for pairs 1 and 3 may be positioned forward of the IDCs for pairs 2 and 4, and may be positioned farther away from the side edges of the printed circuit board (i.e., closer to the middle of the printed circuit board) than are the IDCs for pairs 2 and 4. This IDC arrangement may provide shorter conductive paths for pairs 1 and 3 on the printed circuit board, which may improve the return loss on these pairs, and may also help reduce the number of crossovers where a conductive path of a first differential transmission line on the printed circuit board crosses over or under a conductive path of a different differential transmission line on the printed circuit board.

In some embodiments, the communications jacks may include a printed circuit board (which may be a conventional printed circuit board, a flexible printed circuit board, a rigid-flex printed circuit board, etc.) and may have output contacts such as IDCs that are mounted on both the top and bottom surfaces of the printed circuit board. For example, in some embodiments, RJ-45 communications jacks are provided that have four IDCs (two pairs) that extend upwardly from a top surface of the printed circuit board thereof, while the four IDCs of the other two pairs extend downwardly from the bottom surface of the printed circuit board. This arrangement may reduce crosstalk between the four differential pairs in the wire termination region of the jack.

The communications jacks may have a flexible printed circuit board. The output contacts may be designed to allow for a solder-less connection to the flexible printed circuit board. Such a design may have various advantages including, for example, reduced manufacturing costs. In some embodiments, the output contacts may comprise insulation displacement contacts that have an "action pin" base that are mounted through a metal-plated aperture in a flexible printed circuit board into an underlying mounting substrate. The action pin base includes a pair of opposed serpentine tines. When lower portions of the tines are inserted into an aperture in the dielectric mounting substrate, upper portions of the tines expand outwardly to firmly engage the inner sidewalls of the metal-plated aperture in the flexible printed circuit board to provide a good electrical connection between the insulation displacement contact and the flexible printed circuit board with a solder-less connection. In other embodiments, IDCs having base springs may be used that form solder-less connections with the flexible printed circuit board. Pursuant to still further embodiments, piercing IDCs that have a pair of piercing arms may be used that are punched through a flexible printed circuit board so that a conductive wire structure in the flexible printed circuit board is captured within a channel defined between the piercing arms of the output contact.

As discussed above, the present invention is primarily directed to communications jacks. As used herein, the terms "forward" and "front" and derivatives thereof refer to the direction defined by a vector extending from the center of the jack toward a plug aperture of the jack. The term "rearward" and derivatives thereof refer to the direction directly opposite the forward direction. The forward and rearward directions define the longitudinal dimension of the jack. The vectors extending from the center of the jack toward the respective sidewalls of the jack housing defines the transverse dimension of the jack. For RJ-45 jacks, the blades of an RJ-45 plug that is received within the plug aperture are aligned in a row along the transverse dimension. The transverse dimension is normal to the longitudinal dimension. The vectors extending from the center of the jack toward the respective top and bottom walls of the jack housing define the vertical dimension of the jack. The vertical dimension of the jack is normal to both the longitudinal and transverse dimensions.

The communications jacks according to embodiments of the present invention may comprise, for example, RJ-45 jacks, although embodiments of the present invention are not limited thereto. Moreover, while IDCs are one type of output contact that may be used in embodiments of the present invention, it will be appreciated that insulation piercing contacts or other types of output contacts may be used instead of IDCs in further embodiments of the present invention.

Embodiments of the present invention will now be described with reference to the accompanying drawings, in which example embodiments are shown. Herein, when the communications jacks according to embodiments of the present invention include multiple of the same components, these components may be referred to individually by their full reference numerals (e.g., conductive path 160-4) and may be referred to collectively by the first part of their reference numeral (e.g., the conductive paths 160).

Figure 3:
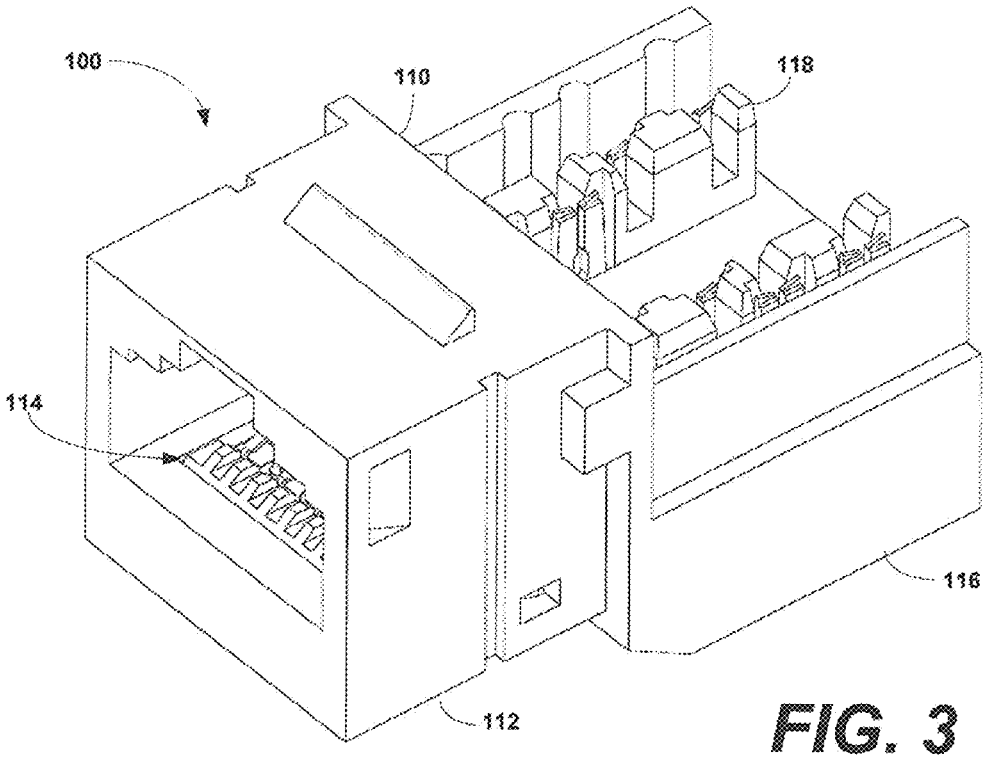
FIG. 3 is a perspective view of a communications jack according to embodiments of the present invention.
Figure 4:
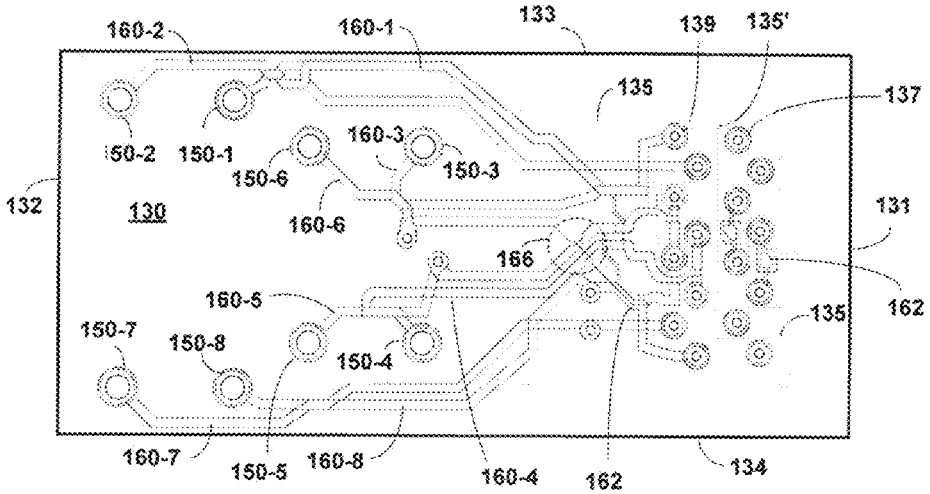
FIG. 4 is a plan view of a flexible printed circuit board that may be used in the communications jack of FIG. 3.
Figure 5:
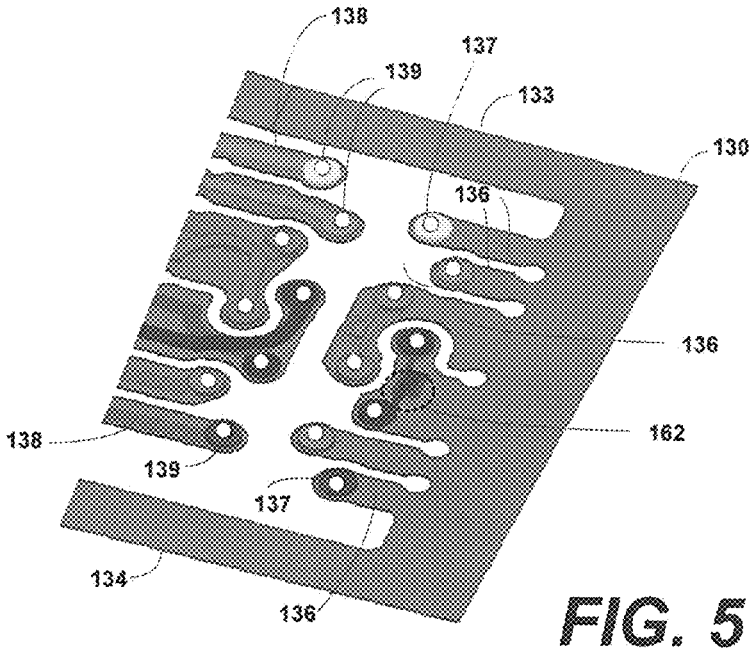
FIG. 5 is a perspective view of a portion of the flexible printed circuit board of FIG. 4 after the printed circuit board has been cut along the scribe lines and had excess portions thereof removed.
Figure 5A:
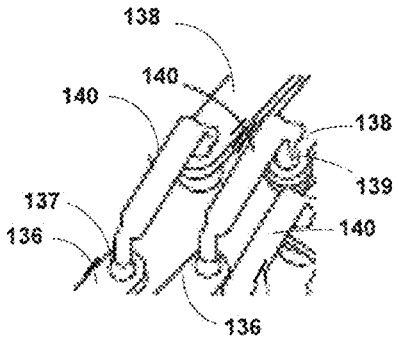
FIG. 5A is a perspective view of a small portion of the printed circuit board of FIG. 5 that illustrates how the jack-wire contacts are mounted on the fingers of the flexible printed circuit board.
Figure 6:
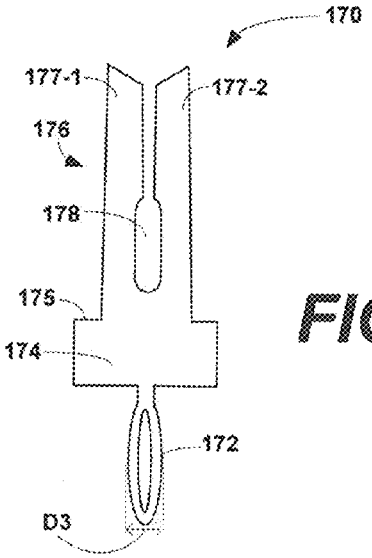
FIG. 6 is a side view of an example IDC that may be used in the communications jack of FIG. 3.
Figure 7:
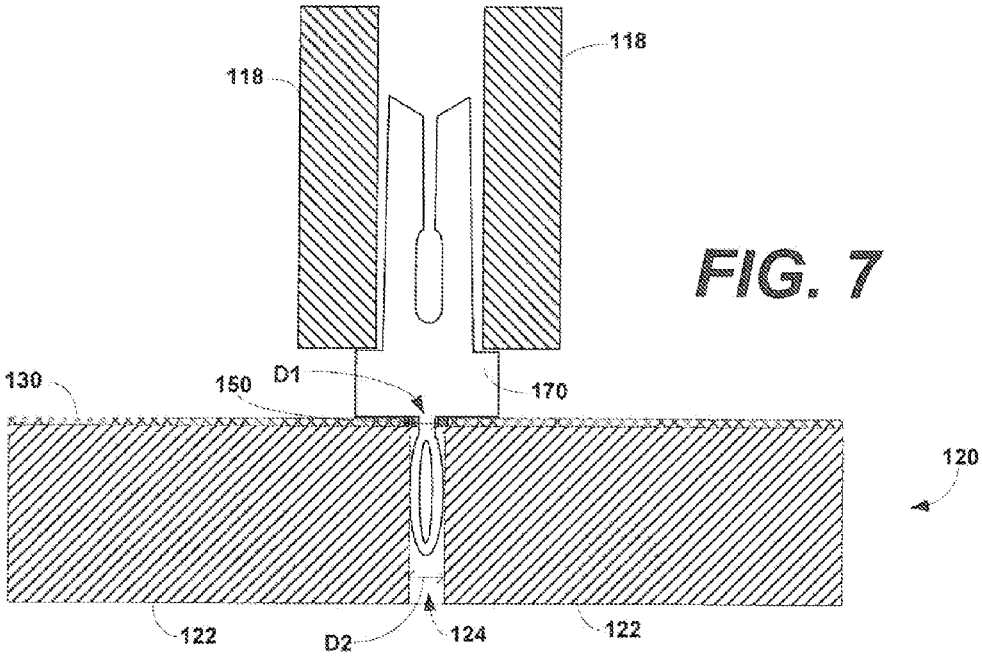
FIG. 7 is a schematic side cross-sectional view illustrating how the IDC of FIG. 6 may be mounted through the flexible printed circuit board of FIG. 4 into a mounting substrate.

FIG. 3 is a perspective view of a communications jack 100 according to embodiments of the present invention. FIG. 4 is a plan view of a printed circuit board 130 that may be used in the jack 100. FIG. 5 is a perspective view of a portion of the printed circuit board 130 of FIG. 4 after it has been cut along the scribe lines and had excess portions thereof removed. FIG. 5A is a perspective view of a small portion of the printed circuit board 130 that illustrates how jackwire contacts are mounted on the fingers of the flexible printed circuit board. FIG. 6 is a side view of an example IDC 170 that may be mounted on the printed circuit board 130. Finally, FIG. 7 is a schematic side cross-sectional view illustrating how the IDC 170 of FIG. 6 may be mounted through the flexible printed circuit board 130 of FIG. 4 into a mounting substrate.

As shown in FIG. 3, the jack 100 includes a housing 110. In the depicted embodiment, the housing 110 includes a jack frame 112, a cover 116 and a terminal housing 118. The jack frame 112 includes a plug aperture 114 for receiving a mating communications plug. The housing components 112, 116, 118 may be conventionally formed and need not be described in detail herein. Those skilled in this art will recognize that other configurations of jack frames, covers and terminal housings may also be employed with the present invention, and that the housing 110 may have more or fewer than three pieces. It will also be appreciated that the jack 100, when mounted for use, is typically rotated 180 degrees about its longitudinal axis from the orientation shown in FIG. 3.

FIG. 4 is a plan view of a flexible printed circuit board 130 that is included in the jack 100. The forward portion of the flexible printed circuit board 130 is received within an opening in the rear of the jack frame 112. The flexible printed circuit board 130 may be mounted on a mounting substrate 122 (see FIG. 7) to form a communications insert 120. The bottom of the communications insert 120 is protected by the cover 116, and the top of the communications insert 120 is covered and protected by the terminal housing 118. The communications insert 120 further includes a plurality of jackwire contacts 140 (see FIG. 5A) and a plurality of output contacts 170 (see FIG. 6).

The flexible printed circuit board 130 may comprise an elongated printed circuit board that is formed of a flexible material. The flexible printed circuit board 130 has a front edge 131, a rear edge 132, and first and second side edges 133, 134 that each connect the front edge 131 to the rear edge 132. The flexible printed circuit board 130 may comprise a fully flexible printed circuit board or a "rigid-flex" printed circuit board that includes both flexible and rigid regions or sections. The flexible printed circuit board 130 includes a plurality of "incision lines" 135. The flexible printed circuit board 130 may be cut along these incision lines 135 to form a plurality of front fingers 136 and a plurality of rear fingers 138, as is shown in FIG. 5. Additional excess printed circuit board material may also be removed adjacent these incision lines 135 so that a gap is provided between the front fingers 136 and the rear fingers 138, as is shown in FIG. 5. In some embodiments, the long transverse incision line that is labeled 135' may extend all the way from the first side edge 133 to the second side edge 134, thereby cutting the flexible printed circuit board 130 into two pieces. Each of the front fingers 136 includes one or more metal-plated apertures 137. Each of the rear fingers 138 includes one or more metal-plated apertures 139. In some embodiments (not shown), one or more fingers may contain three or more metal-plated apertures 137 or 139.

As shown in FIG. 5A, a plurality of jackwire contacts 140 are mounted in two rows on a top surface of the flexible printed circuit board 130. Each jackwire contact 140 comprises a conductive contact that is mounted on the flexible printed circuit board 130 to extend into the plug aperture 114. Each jackwire contact 140 is configured to mate with a blade (or other contact structure) of a communications plug that is received within the plug aperture 114 of the jack 100. A first end of each jackwire contact 140 is mounted in a respective one of the apertures 137 that are provided in the front fingers 136. A second end of each jackwire contact 140 is mounted in a respective one of the metal-plated apertures 139 that are provided in the rear fingers 138. Thus, a total of eight jackwire contacts 140 are provided in the jack 100. A dielectric contact carrier (not shown in the figures) may be disposed underneath each of the jackwire contacts 140, underneath the flexible printed circuit board 130. The ends of each jackwire contact 140 may be mounted through the respective apertures 137, 139 in the flexible printed circuit board 130 and into a respective one of the dielectric contact carriers. The ends of the jackwire contacts 140 can be permanently mounted into their respective apertures 137 and 139 by any conventional means such as, for example, welding, soldering or including eye-of-the-needle terminations on the ends of each jackwire contact 140 that are used to permanently mount the jackwire contacts 140 into corresponding apertures in the dielectric contact carriers. The jackwire contacts 140 may be aligned in two transverse rows that are staggered with respect to each other (as is apparent from the locations of the apertures 137 and 139 that hold the ends of the jackwire contacts 140). The middle section of each jackwire contact 140 may be raised above the top surface of printed circuit board 130 and may comprise a "plug contact region" that engages the blade of a mating plug that is received within the plug aperture 114 of jack 100.

While not shown in the figures, a spring structure may be mounted below the flexible printed circuit board 130 that is used to spring bias the fingers 136, 138. In some embodiments, the spring structure may comprise a comb-like structure formed of a resilient metal that has eight cantilevered teeth that extend from a base. Each tooth of the spring structure is attached to a respective one of the dielectric contact carriers. When a mating plug is received within the plug aperture 114 of jack 100, the blades of the plug depress each jackwire contact 140 downwardly. The teeth of the spring independently bias each dielectric contact carrier and its associated jackwire contact 140 upwardly, thereby ensuring that each jackwire contact 140 maintains a strong contact force with its mating plug blade to provide a good electrical connection therebetween. Each finger 136, 138 may move relatively independently of each of the other fingers 136, 138. This may facilitate ensuring that each jackwire contact 140 will maintain sufficient contact force against its respective mating plug blade, even if some of the plug blades are offset slightly from others of the plug blades in the vertical direction.

The flexible printed circuit board 130 may be used as a transmission medium for signals that pass between the jackwire contacts 140 and the respective output contacts 170 of the jack 100. In particular, as is further shown in FIG. 4, the flexible printed circuit board 130 includes a plurality of conductive paths 160-1 through 160-8. Each conductive path 160 connects a respective one of the metal-plated apertures 139 to a corresponding one of a plurality of metal-plated apertures 150-1 through 150-8 in order to provide eight conductive paths through the flexible printed circuit board 130, which are arranged as four differential pairs of transmission lines. Each conductive path 160 may be formed, for example, as a unitary conductive trace that resides on a single layer of the flexible printed circuit board 130 or as two or more conductive traces that are provided on multiple layers of the flexible printed circuit board 130 and which are electrically connected through metal-filled vias or other layer transferring techniques known to those of skill in the art.

A plurality of crosstalk compensation circuits 162 such as, for example, interdigitated finger capacitors, plate capacitors, inductively coupling traces and the like may also be provided on and/or within the flexible printed circuit board 130. In the depicted embodiment, the crosstalk compensation circuits 162 include plate capacitors as well as inductively coupling trace sections. Only two of the depicted crosstalk compensation circuits 162 are labeled in FIG. 4, but those of skill in the art will recognize that various other crosstalk compensation circuits 162 are included on the flexible printed circuit board 130.

The jack may include eight output contacts 170 (see FIGS. 6 and 7). Each of the eight output contacts 170 may be mounted in a respective one of the metal-plated apertures 150-1 through 150-8 in flexible printed circuit board 130. The output contacts 170 may each include a base portion that extends through the apertures 150 and into corresponding apertures in the substrate 122 that are provided beneath flexible printed circuit board 130.

In some embodiments, each output contact 170 may comprise an IDC. As shown in FIG. 6, each IDC may include a base 172, a central section 174, and an insulation displacement section 176. The base 172 may have, for example, an eye-of-the-needle configuration or other compliant pin configuration that facilitates press-fit mounting the base 172 of IDC 170 in a mounting substrate without welding, soldering, gluing or another process that permanently adheres the IDC 170 to the mounting substrate. The insulation displacement section 176 may include a pair of upwardly extending arms 177-1, 177-2 that define a channel 178 therebetween. The channel 178 may be configured to receive an insulated conductor of a communications cable, and may be designed so that the inner edges of the arms 177-1, 177-2 slit the insulation when the insulated conductor is inserted into the channel 178 so that the arms 177-1, 177-2 cut into the conductor core of the insulated conductor to provide a good mechanical and electrical connection between the conductive core of the insulated conductor and the IDC 170. The central portion 174 may include one or more shoulders 175. Interior features of the terminal housing (see FIG. 7) may engage the shoulders 175 when the terminal housing 118 is affixed to the jack 100 which may assist in holding the IDC 170 in place. Each of the IDCs 170 is mounted to be in electrical contact with the flexible printed circuit board 130.

FIG. 7 is a schematic side cross-sectional view illustrating how the IDC 170 of FIG. 6 may be mounted through the flexible printed circuit board 130 into the mounting substrate. As shown in FIG. 7, the mounting substrate 122 includes an aperture 124. A top opening of the aperture 124 may have a width D1, while a lower portion of the aperture 124 has a width D2 that exceeds D1. The base 172 of IDC 170 is inserted into the top opening of the aperture 124. The base 172 is in the form of an eye-of-the-needle configuration that has a maximum width D3 (see FIG. 6) that exceeds width D1 and which is less than or equal to width D2. As the base 172 is inserted into aperture 124, the eye-of-the-needle termination is compressed inwardly until it has a maximum width that is essentially the same as D1. This allows the eye-of-the needle termination to pass through the top opening of the aperture 124. Once through the top opening of aperture 124, the eye-of-the-needle termination expands outwardly back to its original width D3. As D3 is greater than D1, the eye of the needle termination is trapped within the aperture 124 and can only be removed by the application of a fairly large force.

As shown in FIG. 7, the flexible printed circuit board 130 may be directly on top of the substrate 122. In some embodiments, the flexible printed circuit board 130 may be glued or otherwise bonded to the top surface of the substrate 122.

Pursuant to embodiments of the present invention, various arrangements are disclosed for the output contacts 170 that may provide improved performance and, in particular, improved crosstalk and return loss performance for the differential transmission lines of jack 100. While in the example discussed herein the output contacts 170 are implemented as IDCs, it will be appreciated that other types of output contacts may be used in further embodiments.

Turning first to FIG. 4, it can be seen that the metal-plated apertures 150-1 through 150-8 that hold the IDCs 170 are arranged as four differential pairs of apertures 150 that will hold four differential pairs of IDCs 170. The differential pairs of IDCs 170 are referred to herein according to the pair numbering under the TIA 568 type B modular jack contact wiring assignments (where the IDCs 170 are numbered in the same way as the jackwire contacts that they are electrically connected to). Thus, as is readily apparent, the IDCs 170 of pair 2 (namely the IDCs 170 mounted in apertures 150-1 and 150-2) are positioned adjacent the first side edge 133 near the rear edge 132 of flexible printed circuit board 130, and the IDCs 170 of pair 4 (the IDCs 170 mounted in apertures 150-7 and 150-8) are positioned adjacent the second side edge 134 near the rear edge 132 of flexible printed circuit board 130. The IDCs 170 of pair 3 (the IDCs 170 mounted in apertures 150-3 and 150-6) are positioned closer to the first side edge 133 of flexible printed circuit board 130, but farther away from side edge 133 than are the IDCs 170 of pair 2, and are positioned farther away from the rear edge 132 of flexible printed circuit board 130 than are the IDCs 170 of pair 2. The IDCs 170 of pair 1 (the IDCs 170 mounted in apertures 150-4 and 150-5) are positioned closer to the second side edge 134 of flexible printed circuit board 130, but farther away from side edge 134 than are the IDCs 170 of pair 4, and are positioned farther away from the rear edge 132 of flexible printed circuit board 130 than are the IDCs 170 of pair 4. In this particular embodiment each IDC 170 is a planar IDC that extends along the longitudinal dimension of the jack 100, and the IDCs 170 of each pair are longitudinally aligned (see FIG. 4). Additionally, the IDCs 170 of pair 2 are transversely aligned with the corresponding IDCs 170 of pair 4, and the IDCs 170 of pair 3 are transversely aligned with the corresponding IDCs 170 of pair 1.

The above-described IDC configuration may have a number of advantages. First, the IDC arrangement of FIG. 4 may reduce the number of locations where it is necessary to have a conductive path 160 that is associated with one differential pair cross over one or more conductive paths 160 that are associated with a different differential pair. As is well understood by those of skill in the art, when it is necessary to have two of the conductive paths 160 cross over each other, this is typically done by routing the first conductive path 160 on a first layer of the printed circuit board 130 and the second conductive path 160 on a second, different layer of the printed circuit board 130 so that the two conductive paths 160 cross over/under each other (when the printed circuit board 130 is viewed from above or below) without short-circuiting the two conductive paths 160. As more crossovers are required, it will generally become necessary to include more conductive vias that are used to transfer a conductive path 160 from one layer of the printed circuit board 130 to a different layer in order to implement these crossovers. This can increase the expense of the flexible printed circuit board 130, and care should also be taken to ensure that unintended coupling between these conductive vias does not introduce unintended crosstalk that degrades the performance of the jack 100. Thus, reducing the number of times that conductive paths 160 of different differential pairs cross over each other may reduce manufacturing costs and may also help avoid unintended degradations in the crosstalk performance of the jack 100.

More importantly, in jacks that use flexible printed circuit boards, a significant amount of capacitive and/or inductive coupling may be generated when two conductive paths 160 cross over each other. Thus, any such capacitive and inductive coupling that is generated as a result of a conductive path 160 of a first differential pair crossing over conductive paths 160 of other differential pairs in order to route the conductive paths 160 to their corresponding IDCs 170 should be taken into account in the crosstalk compensation scheme that is implemented in the jack 100. This may complicate providing an optimized crosstalk compensation scheme. Moreover, it is generally advantageous to implement crosstalk compensation (and, in particular, crosstalk compensation that has the opposite polarity as the offending crosstalk that is generated in, for example, a mating plug) as close in time to the plug-jack mating point as possible, as, all else being kept equal, compensating crosstalk is generally more effective the closer in time it is to the offending crosstalk that it is intended to cancel. Because the metal-plated vias 139 that hold the jackwire contacts 140 and the provision of crosstalk compensation circuits 162 adjacent these vias 139 tend to take up much of the available space on the printed circuit board 130 around the region where the jackwire contacts 140 terminate into the flexible printed circuit board 130 (see, e.g., FIG. 4), it may be necessary to have some of the conductive paths 160 cross over each other farther back on the printed circuit board 130 (i.e., more toward the back edge 132), and hence these crossovers may occur at higher delays. Such crosstalk is typically less effective at cancelling the offending crosstalk, and hence provides another reason why it may be advantageous to reduce the number of crossovers.

In the embodiment of FIG. 4, conductive path 160-6 is the only conductive path that crosses over the conductive paths of other differential pairs for routing reasons. In particular, as can be seen in FIG. 4, conductive path 160-6 (of pair 3) crosses under conductive paths 160-4 and 160-5 (of pair 1) at a crossover location 166. While no other full crossovers of conductive paths 160 of different differential pairs are provided on the flexible printed circuit board 130, in four other locations short segments of conductive paths 160 of two different pair are intentionally overlapped for purposes of generating compensating crosstalk. In particular, conductive paths 160-1 and 160-3 overlap, conductive paths 160-3 and 160-5 overlap, conductive paths 160-4 and 160-6 overlap, and conductive paths 160-6 and 160-8 overlap. However, none of these overlapping trace sections comprises a full crossover.

Additionally, as can further be seen in FIG. 4, the conductive paths 160-1 and 160-2 of pair 2 may be routed between the side edge 133 of flexible printed circuit board 130 and the IDCs 170 of pair 3. Similarly, the conductive paths 160-7 and 160-8 of pair 4 may be routed between the side edge 134 of flexible printed circuit board 130 and the IDCs 170 of pair 1. The conductive paths 160-3 through 160-6 for pairs 1 and 3 are routed down a central section of flexible printed circuit board 130. By routing the conductive paths 160 across the full width of the flexible printed circuit board 130, it is possible increase the separation between adjacent pairs of differential conductive paths 160. This may advantageously reduce unintended coupling between conductive paths 160 of different differential pairs. Additionally, as the insulated conductors of the communications cable are generally routed longitudinally along the middle section of the top surface of the flexible printed circuit board 130, by routing the conductive paths 160 for pairs 2 and 4 along the side edges of the flexible printed circuit board 130 it may be possible to reduce coupling between the insulated conductors and the conductive paths 160-1, 160-2, 160-7 and 160-8 since the insulated conductors will not run directly on top of these conductive paths 160.

Additionally, the IDC arrangement illustrated in FIG. 4 also may advantageously reduce the lengths of the conductive paths 160 of pairs 1 and 3. As is known to those of skill in the art, in an RJ-45 plug, the highest crosstalk levels are generated between pairs 1 and 3, and hence communications jacks typically inject the highest levels of compensating crosstalk on pairs 1 and 3. The higher levels of offending and compensating crosstalk that are injected onto pairs 1 and 3, however, typically make it harder to maintain good return loss and insertion loss on these pairs. As, generally speaking, longer transmission lines will exhibit lower return loss and higher insertion loss values, it may be advantageous to reduce the length of the conductive paths 160 for pairs 1 and 3. As the IDC arrangement of the embodiment of FIG. 4 has such shortened conductive paths 160, it may exhibit improved return loss and insertion loss performance on those pairs.

While the jack 100 includes a single flexible printed circuit board 130, it will be appreciated that in other embodiments the flexible printed circuit board 130 may be replaced with a conventional rigid printed circuit board or a hybrid rigid-flexible printed circuit board. It will also be appreciated that the flexible printed circuit board 130 may be replaced with two or more printed circuit boards or other substrates. Thus, the above description simply illustrates one example jack in which the IDC arrangement according to embodiments of the present invention may be used, and it will be appreciated that this arrangement may be used in a wide variety of other jacks. It will also be appreciated that the IDCs 170 need not be disposed longitudinally, and that the IDCs 170 of each pair need not be longitudinally aligned.

Pursuant to further embodiments of the present invention, RJ-45 communications jacks are provided which have output contacts that extend from both major surfaces of a printed circuit board of the jack.

Figure 8A:
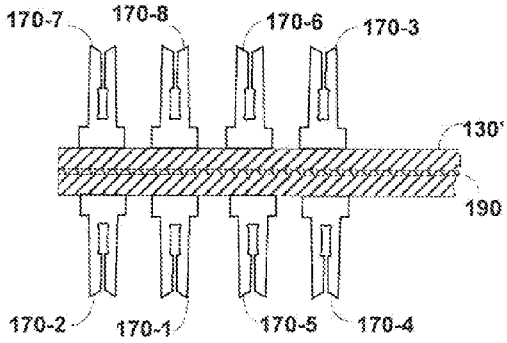
FIGS. 8A and 8B are schematic side and rear views, respectively, illustrating a printed circuit board and output contacts of a communications jack according to further embodiments of the present invention in which output contacts extend from both the top and bottom sides of the printed circuit board.
Figure 8B:
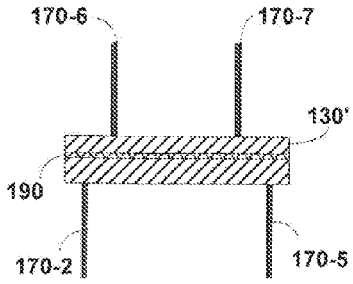

FIGS. 8A and 8B are schematic side and rear views, respectively, illustrating a printed circuit board 130' of a communications jack according to further embodiments of the present invention. The printed circuit board 130' may be a conventional printed circuit board that has IDC apertures 150 in the exact locations shown in FIG. 4 for the printed circuit board 130. Eight output contacts 170-1 through 170-8 are mounted on the printed circuit board 130'. However, as shown in FIGS. 8A and 8B, in this alternative embodiment, four of the IDCs 170 extend upwardly from the top surface of printed circuit board 130', while the other four IDCs 170 extend downwardly from the bottom surface of printed circuit board 130'. Consequently, four of the conductors of the communications cable that is terminated into the jack would be routed over the top surface of the printed circuit board 130' to the four "top" IDCs 170, while the other four conductors of the communications cable that is terminated into the jack would be routed under the bottom surface of the printed circuit board 130' to the four "bottom" IDCs 170. In the depicted embodiment, the IDCs 170 for pairs 3 and 4 extend upwardly from the top surface of printed circuit board 130', while the IDCs 170 for pairs 1 and 2 extend downwardly from the bottom surface of printed circuit board 130'. It will be appreciated, however, that in other embodiments, the IDCs 170 of any two of the pairs may extend upwardly from the top surface of printed circuit board 130' while the IDCs 170 for the other two pairs extend downwardly from the bottom surface of printed circuit board 130'. It will also be appreciated that in still further embodiments, the IDCs 170 for three of the pairs may extend upwardly from one major surface (i.e., the top or bottom surface) of printed circuit board 130', while the IDCs 170 for the remaining pair extend downwardly from the other major surface of printed circuit board 130', or vice versa.

A jack having the output contact arrangement of FIGS. 8A and 8B may exhibit improved crosstalk performance. In particular, by having the IDCs 170 for pairs 1 and 3 extend in different directions, the insulation displacement portions (portion 176 in FIG. 6) of the IDCs 170 of these pairs no longer face each other. As the facing insulation displacement portions 176 of the IDCs 170 are plate-like elements, capacitive coupling (along with some degree of inductive coupling) may be generated therebetween. While the magnitude of this coupling may be limited by the degree of physical separation and by intervening structures such as the terminal housing and the insulated conductors of the cable, the unbalanced coupling between pairs 1 and 3 may still be non-trivial, particularly for high frequency signals. By arranging the insulation displacement portions 176 of the IDCs 170 of pairs 1 and 3 so that they no longer face each other, the amount of unbalanced coupling between pairs 1 and 3 may be reduced. Also the coupling between the insulated conductors of the communications cable that is terminated into the printed circuit board 130' may be reduced by the greater physical separation, as further described below. Similar improvements may be achieved in the reduction of unbalanced coupling between the IDCs 170 of pairs 2 and 4, although the initial amount of unbalanced coupling between the IDCs 170 of these pairs is typically less, as the IDCs 170 of pairs 2 and 4 are separated by a larger distance than are the IDCs 170 of pairs 1 and 3.

Additionally, a jack having the IDC arrangement of FIGS. 8A and 8B may also exhibit less unbalanced coupling between the insulated conductors of the communications cable that is terminated into the IDCs 170. In particular, in the jack 100 of FIGS. 3-7, all eight insulated conductors of the communications cable would typically be routed between the IDCs of pairs 2 and 4. While the insulated conductors are typically maintained in their twisted state to reduce the amount of unbalanced coupling between pairs, at the IDCs 170 the twist is eventually terminated, and this may result in increased unbalanced coupling. Moreover, in practice, the jacks 100 may be field terminated by a technician who may not be particularly careful in maintaining the twist in the insulated conductors to the greatest extent possible. This may further increase the amount of unbalanced coupling that is injected between the pairs of insulated conductors.

By routing two of the pairs of insulated conductors along each side (top, bottom) of the printed circuit board 130' it may be possible to reduce the coupling therebetween. In particular, if only two pairs of conductors are routed on each side of the printed circuit board 130', it may be possible to increase the physical separation between the insulated conductors of the two pairs on each side of the printed circuit board 130'. Additionally, floating image planes and/or ground planes may be included in the printed circuit board 130'. Such an image/ground plane 190 is illustrated in FIGS. 8A and 8B, which may be implemented as a conductive layer within the printed circuit board 170. The image/ground plane 190 may reduce coupling between structures on the top side of the printed circuit board 130' with structures on the bottom side thereof (such as insulated conductors). Thus, the IDC arrangement of FIGS. 8A and 8B may not only exhibit reduced crosstalk between the IDCs 170 themselves, but may also exhibit reduced crosstalk between the insulated conductors of the communications cable that is terminated onto the printed circuit board 130'.

Figure 9A:
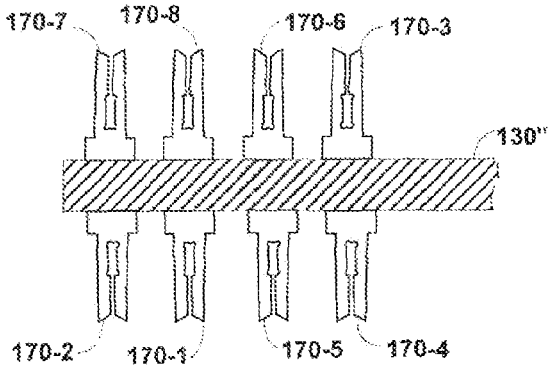
FIGS. 9A and 9B are schematic side and rear views, respectively, illustrating mounting locations for output contacts in communications jacks according to further embodiments of the present invention.
Figure 9B:
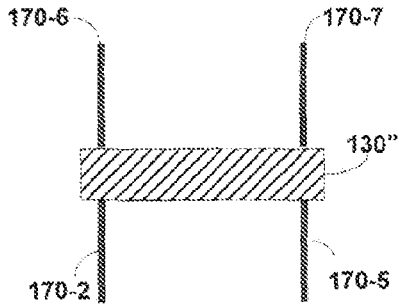

FIGS. 9A-9B are a schematic side view and rear view, respectively, that illustrate mounting locations for output contacts on a printed circuit board 130" according to further embodiments of the present invention. As shown in FIGS. 9A and 9B, in this embodiment, the IDCs 170 of pairs 2 and 3 are longitudinally aligned along the first side edge of the printed circuit board 130, while the IDCs 170 of pairs 1 and 4 are longitudinally aligned along a second side edge of the printed circuit board 130". As in the embodiment of FIGS. 8A and 8B, the IDCs 170 for pairs 3 and 4 extend upwardly from the top surface of flexible printed circuit board 130', while the IDCs 170 for pairs 1 and 2 extend downwardly from the bottom surface of flexible printed circuit board 130'. In this arrangement it may be more difficult to route the conductive paths for pairs 2 and 4 outside of the IDCs 170 of pairs 1 and 3 as is the case in the embodiment of FIG. 4 that is discussed above. However, even greater separation may be achieved between the IDCs 170 of pairs 1 and 3, which may reduce coupling between the IDCs 170 of pairs 1 and 3 and may also allow the two pairs of insulated conductors that are routed on each side of the printed circuit board 130" to be separated farther apart from each other.

Figure 10A:
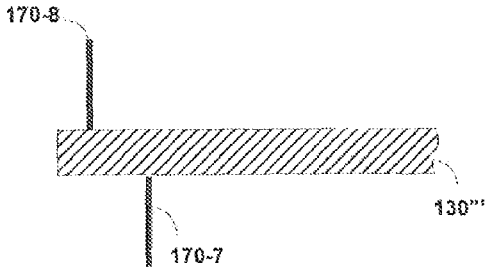
FIGS. 10A and 10B are schematic side and rear views, respectively, illustrating mounting locations for output contacts in communications jacks according to still further embodiments of the present invention.
Figure 10B:
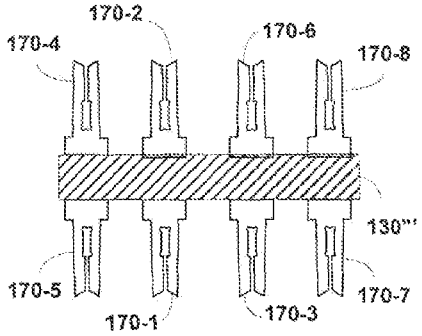

FIGS. 10A-10B are a schematic side view and rear view, respectively, that illustrate mounting locations for output contacts on a printed circuit board 130'" according to still further embodiments of the present invention. In this embodiment, one IDC 170 of each pair extends upwardly from the top surface of the printed circuit board 130'", while the other IDC 170 of each pair extends downwardly from the bottom surface of printed circuit board 130" The IDCs 170 of each pair may be longitudinally aligned. As shown in FIG. 10B, each IDC 170 may extend transversely (in contrast to the other embodiments discussed above, in which the IDCs 170 extend longitudinally). This may facilitate maintaining the twist in the insulated conductors right up to the IDCs 170, as the insulated conductors do not have to experience a ninety degree turn before terminating into the IDCs 170. Moreover, as four of the IDCs 170 terminate into the bottom side of the printed circuit board 130", the IDCs 170 may be oriented along the transverse dimension and still have sufficient room therebetween to have minimal coupling. In other embodiments (not shown), each IDC 170 may be rotated ninety degrees to extend longitudinally.

Pursuant to still further embodiments of the present invention, communications jacks are provided that have "action pin" output contacts that may be physically and electrically connected to a flexible printed circuit board without soldering, welding or the like. These action pin output contacts may thus simplify the manufacture of communications jacks such as RJ-45 jacks.

Many conventional RJ-45 jacks include conventional printed circuit boards. A plurality of jackwire contacts are mounted on the conventional printed circuit board to extend into a plug aperture of the jack, and a plurality of output contacts, typically in the form of IDCs, are mounted on a back end of the printed circuit board. Typically, the base of each IDC is an eye-of-the needle post or other compliant pin termination that may be mounted into a corresponding metal-plated aperture on the printed circuit board without any need to weld or solder the IDC in place. Internal features on the terminal housing may assist with holding the IDCs in place on the printed circuit board.

Conventional printed circuit boards that are used in RJ-45 jacks are typically fairly thick, with a thickness of on the order of 30-100 mils being quite common. In contrast, flexible printed circuit boards are much, much thinner, often having a thickness of 1-5 mils or less. Consequently, flexible printed circuit boards may be too thin to receive and properly mate with an output contact such as an IDC that includes an eye-of-the-needle termination. Accordingly, a mounting substrate may be provided below the flexible printed circuit board (see discussion above), and the base of the output contact may be mounted through a metal-plated aperture in the flexible printed circuit board into the underlying mounting substrate.

Unfortunately, it may be difficult to ensure that a reliable electrical connection is maintained between an output contact such as an IDC that is mounted through a metal-plated aperture in a flexible printed circuit board into an underlying mounting substrate. Accordingly, it may be necessary to solder or weld the base of the IDC to the metal-plated aperture in the flexible printed circuit board. Including soldering or welding operations in the manufacturing process may result in an undesirable increase in the cost of manufacturing the jack. The action pin output contacts according to embodiments of the present invention may reduce or eliminate the need for any such soldering or welding operations.

Figure 11A:
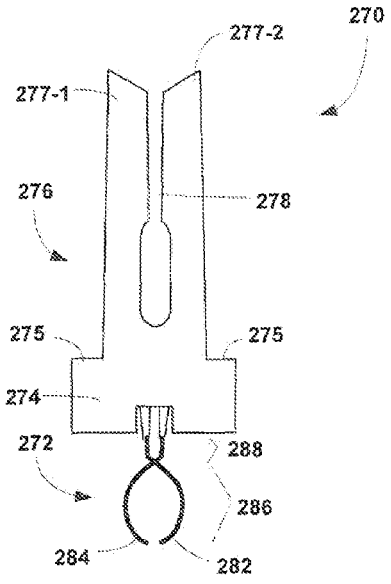
FIG. 11A is a schematic side view of an action pin output contact according to embodiments of the present invention.
Figure 11B:
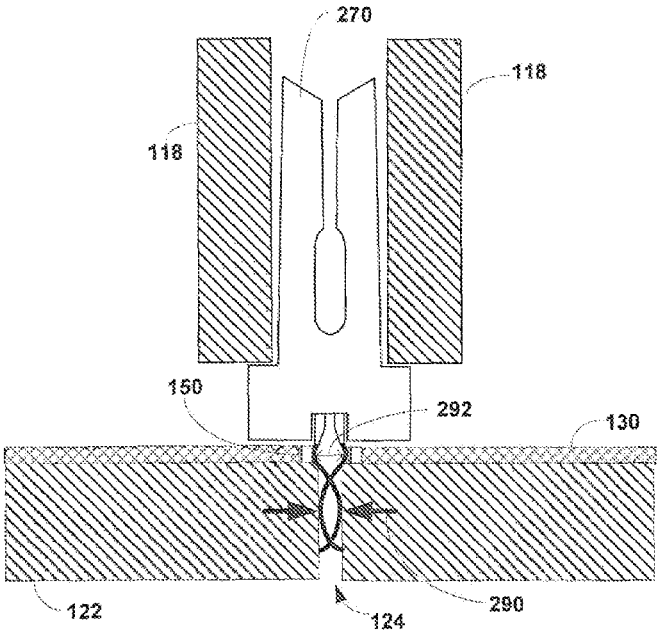
FIG. 11B is a schematic side view of illustrating how the action pin output contact of FIG. 11A may be electrically connected to a flexible printed circuit board via a solder-less connection.

FIGS. 11A and 11B schematically illustrate an action pin IDC output contact according to embodiments of the present invention. In particular, FIG. 11A is a schematic side view of an action pin IDC 270, and FIG. 11B is a schematic side view of illustrating how the action pin IDC 270 may be electrically connected to the flexible printed circuit board 130 via a solder-less connection. The IDC 270 may be used, for example, as an output contact in the communications jack 100 that is described above.

As shown in FIG. 11A, the action pin IDC 270 includes a base 272, a center portion 274 and an insulation displacement contact portion 276. The IDC 270 may be formed, for example, of a semi-resilient metal such as alloy 638, alloy 688 or beryllium copper. The insulation displacement contact portion 276 may be a planar component that includes a pair of upwardly extending arms 277-1, 277-2. A channel 278 is defined between the arms 277-1, 277-2. The interior edges of the arms 277-1, 277-2 may be designed to slice through the insulation of an insulated conductor that is received therebetween. The diameter/width of the bottom portion of the channel 278 may be slightly less than the minimum diameter of the conductive core of the insulated conductor that is to be received within the channel 278 in order to ensure that the insulation displacement contact portion 276 establishes a good electrical connection with the conductive core of any insulated conductor received therein. The center portion 274 includes a pair of shoulders 275. As is discussed below, features of the terminal housing may press against the top surfaces of these shoulders 275 to lock the IDC 270 against the top surface of the flexible printed circuit board 130.

The base 272 of IDC 270 comprises a pair of downwardly extending tines 282, 284, each of which have a serpentine shape. In the depicted embodiment, the bottom portion of each tine 282, 284 generally has an "S" shape. As is discussed below, the tines 282, 284 are designed so that when a lower portion 286 of the S-shaped region of each tine 282, 284 is received within an aperture 124 in a mounting substrate 122 (i.e., the lower portions 286 are compressed toward each other), an upper portion 288 of the S-shaped region of each tine 282, 284 expand outwardly (in opposite directions). The outwardly expanding nature of the upper portions 288 of the S-shaped region of each tine 282, 284 may be used to provide a good electrical connection to a metal-plated aperture 150 through the flexible printed circuit board 130, as will be discussed below.

In particular, as shown in FIG. 11B, the IDC 270 is mounted by inserting the lower portion 286 of the S-shaped region of each tine 282, 284 into the aperture 124 in the mounting substrate 122. The upper portion 288 of the S-shaped region of each tine 282, 284 is designed to fall within the metal-plated aperture 150 in the flexible printed circuit board 130. When the lower portion 286 of the S-shaped region of each tine 282, 284 is inserted into the aperture 124, the portion of each tine 282, 284 that is received within the aperture 124 is forced inwardly, as each tine 282, 284 is wider than the diameter of the aperture 124. This is shown by the arrows labeled 290 in FIG. 11B. Because each tine 282, 284 has a serpentine shape, the inward flexing of the lower portion 286 of each tine 282, 284 causes the upper portion 288 of the S-shaped region of each tine 282, 284 to expand outwardly. As is shown by the arrows 292 in FIG. 11B, the upper portions 288 of the S-shaped region of the tines 282, 284 expand outwardly in opposite directions. Thus, the inward deflection that the sidewalls of the aperture 124 induce on the lower portion 286 of the S-shaped region of each tine 282, 284 in turn deflects the upper portion 288 of the S-shaped region of each tine 282, 284 outwardly, thereby generating constant pressure between the upper portion 288 of the S-shaped region of each tine 282, 284 and the inner sidewalls of the metal-plated aperture 150 in the flexible printed circuit board 130.

Thus, pursuant to embodiments of the present invention, communications jacks are provided that have output contacts such as IDCs that are mounted through respective conductive vias in a flexible printed circuit board and into a respective one of a plurality of apertures in an underlying mounting substrate. As the base of each output contact is received within its respective aperture in the mounting substrate, the sidewalls of the aperture compress the bottom portion of the base and cause a top portion of the base of the output contact member to expand outwardly such that it firmly engages the sidewalls of the conductive via in the flexible printed circuit board. In this manner, a good electrical connection can be established between each output contact and its corresponding conductive via in the flexible printed circuit board without any need for soldering or welding the output contacts to their corresponding conductive vias.

Figure 12:
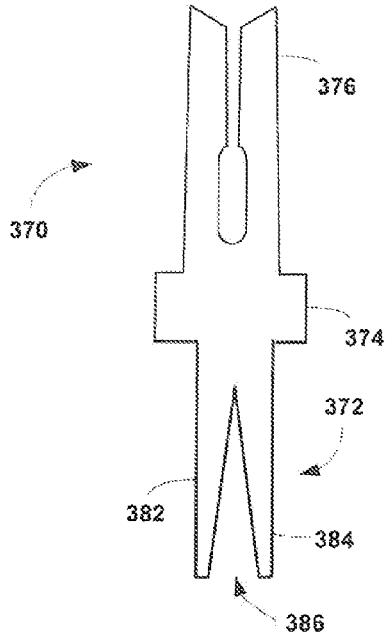
FIG. 12 is a schematic side view of an output contact according to further embodiments of the present invention that may be used to make a solder-less connection to a flexible printed circuit board.

FIG. 12 is a schematic front view of an IDC 370 according to further embodiments of the present invention that may be used in the communications jack 100 that is described above.

As shown in FIG. 12, the IDC 370 includes a base 372, a central portion 374 and an insulation displacement contact portion 376. The insulation displacement contact portion 376 may be identical to the insulation displacement contact portion 176 of the IDC 170, and hence further discussion thereof will be omitted. The base 372 includes a pair of downwardly extending arms 382, 384. The arms 382, 384 define a channel 386 (e.g., a v-shaped channel) therebetween. The inner edges of arms 382, 384 may be sharpened in some embodiments, and the distal ends of arms 382, 384 may also be sharpened or formed as points. The arms 382, 384 and the channel 386 form a termination that may be used to electrically connect the IDC 370 to a conductive structure on a flexible printed circuit board.

In particular, flexible printed circuit boards are available that have polyester dielectric layers or other dielectric materials that may be very flexible when heated. The points on the distal ends of arms 382, 384 may be pressed through a flexible printed circuit board and into a corresponding slot in a mounting substrate that is provided below the flexible printed circuit board. The flexible printed circuit board may include a conductive "wire" that is positioned to fall within the channel 386 when the base 372 of IDC 370 is punched through the flexible printed circuit board. This conductive wire may comprise, for example, a heavy build-up of copper or another conductive material on one or more layers of the flexible printed circuit board. The inner edges of the arms 382, 384 may cut into and/or press against the conductive wire in the flexible printed circuit board to establish a mechanical connection and an electrical connection between the IDC 370 and the flexible printed circuit board without the need for soldering, welding or the like.

Figure 13:
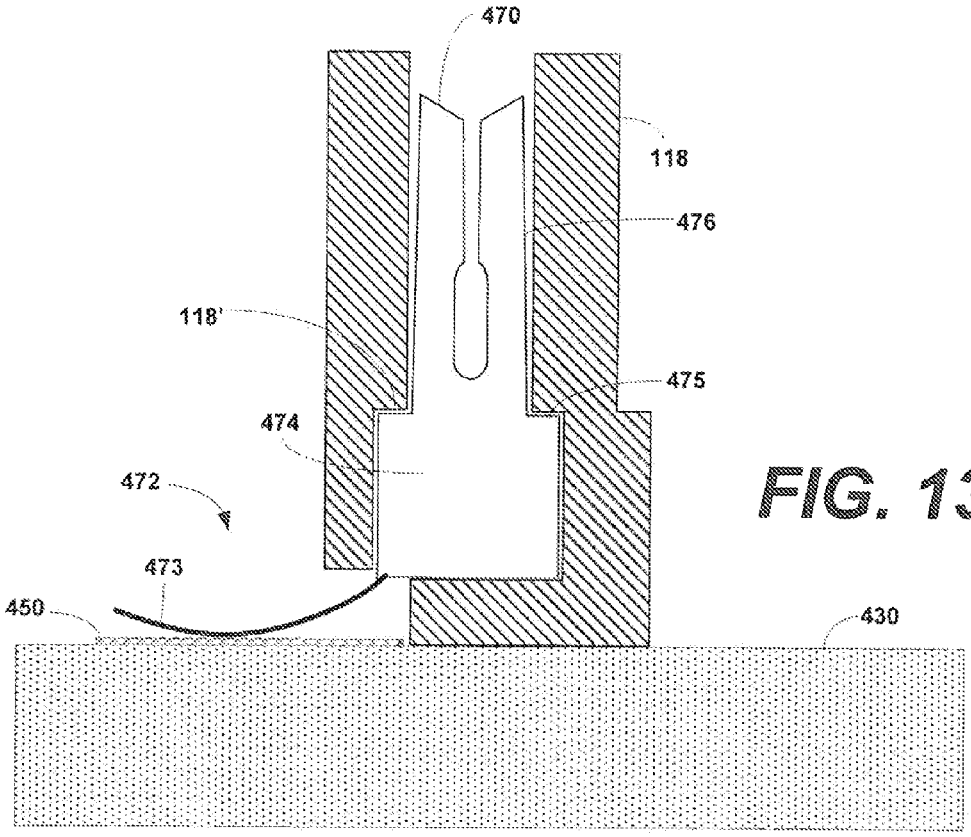
FIG. 13 is a schematic side view of an IDC according to further embodiments of the present invention that illustrates how the IDC may electrically connect to a flexible printed circuit board via a spring-biased sliding contact connection.

Pursuant to still further embodiments of the present invention, communications jacks are provided that include spring output contacts that electrically connect to a flexible printed circuit board via a sliding, spring-biased contact connection. FIG. 13 is a schematic side view of such a spring output contact 470 according to certain embodiments of the present invention. The output contact 470 may be used for example, in the jack 100 that is described above in place of the IDCs 170. The output contact 470 may be used to make a solderless connection to a flexible printed circuit board.

As shown in FIG. 13, the output contact 470 comprises an IDC that has a base 472, a central portion 474 and an insulation displacement contact portion 476. The IDC 470 may be stamped from sheet metal and then formed into the shape illustrated in FIG. 13. The insulation displacement contact portion 476 may be identical to the insulation displacement contact portion 176 of the IDC 170, and hence further discussion thereof will be omitted. The base 472 may comprise a downwardly extending member that is twisted ninety degrees and then bent into a curved shape, as shown. The IDC 470 may be formed of a resilient metal so that the downwardly extending member 472 comprises a spring.

A conductive contact pad 450 may be provided on an upper surface of a flexible printed circuit board 430. The terminal housing 118 of the jack 100, when locked in place by, for example, ultrasonic welding, snap-clips or the like, holds the IDC 470 in place over the contact pad 450. Features 118' on the interior of the terminal housing 118 may mate against features on the IDC 470 such as the shoulders 475. The terminal housing 118 may be designed so that when it is moved into its final, resting position it presses the IDC 470 downward so as to spring bias the base 472 against the conductive pad 450 on the flexible printed circuit board 430. The curved portion 473 of the base 472, when spring-biased by the terminal housing 118, may slide against the contact pad 450 to provide a firm mechanical connection and a good electrical connection between the IDC 470 and the flexible printed circuit board 430. The IDC 470 also may comprise a solderless connection between the output contact and the flexible printed circuit board 430.

Figure 14:
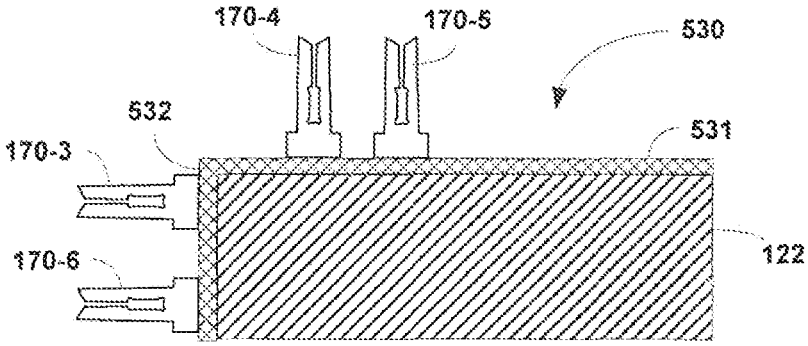
FIG. 14 is a schematic side view illustrating how a flexible printed circuit board of a communications jack may be folded to further reduce coupling between the output contacts of the jack according to further embodiments of the present invention.

FIG. 14 is a schematic side view of a flexible printed circuit board 530 according to further embodiments of the present invention that illustrates how a flexible printed circuit board of a communications jack may be folded to further reduce coupling between the output contacts of the jack.

As shown in FIG. 14, the flexible printed circuit board 530 is mounted on a mounting substrate 122. The flexible printed circuit board 530 may be used in the jack 100 of FIG. 3, with the terminal housing 118 of the jack 100 modified appropriately to accommodate the different IDC arrangement illustrated in FIG. 14.

As shown in FIG. 14, in this embodiment the flexibility of the printed circuit board 530 is taken advantage of to bend a back section 532 of the flexible printed circuit board 530 downward at a ninety degree angle. Four of the output contacts (namely IDCs 170) are mounted on the back section 532 that is folded downward, while the other four IDCs 170 are mounted on a front section 531 of the flexible printed circuit board 530. The mounting substrate 122 may be positioned so that all eight IDCs 170 may be mounted through the flexible printed circuit board 530 into the mounting substrate 122. The coupling between the IDCs 170 mounted on the rear section 532 with the IDCs 170 mounted on the front section 531 may be minimal.

It will be appreciated that the IDCs may be placed in any arrangement on the front and rear sections 531, 532. Thus, for example, while in the depicted embodiment two pairs (pairs 2 and 3) are placed on the rear section 532 in transverse alignment (the IDCs 170 of pair 2 are not visible in the side view of FIG. 14 as they are hidden by the IDCs 170 of pair 3), and two pairs (pairs 1 and 4) are placed on the front section 531 in transverse alignment (the IDCs 170 of pair 4 are not visible in the side view of FIG. 14 as they are hidden by the IDCs 170 of pair 1), it will be appreciated that numerous other embodiments are possible. For example, the locations of the pairs may be changed, the number of pairs on the front and rear sections 531, 532 may be changed, the positions of the IDCs 170 may be changed (e.g., the two pairs on the front section 531 may not be transversely aligned), etc. It will likewise be appreciated that the angle at which the flexible printed circuit board 530 is bent may be different than a ninety degree angle. Also it will be appreciated that the fold between the surfaces 531 and 532 may be rounded according to an appropriate bend radius in order to reduce the stress on the flexible printed circuit board 530.

Figure 15:
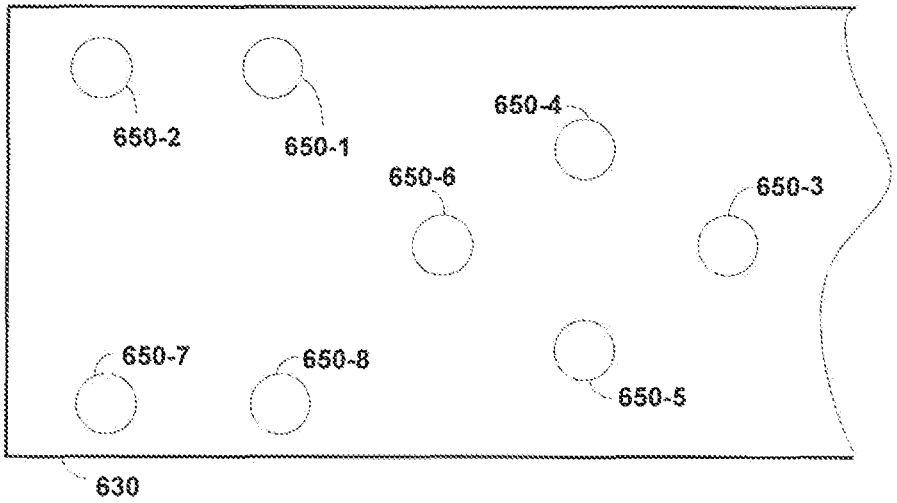
FIG. 15 is a plan view of a portion of a printed circuit board according to still further embodiments of the present invention.

FIG. 15 is a schematic plan view of a portion of a printed circuit board 630 according to still further embodiments of the present invention. The printed circuit board 630 may be very similar to the printed circuit board 130 discussed above with reference to FIG. 4, except that the metal-plated apertures 150-1 through 150-8 are replaced with metal-plated apertures 650-1 through 650-8, some of which are positioned in different locations on the printed circuit board. Accordingly, the discussion below will focus solely on this change from the printed circuit board 130 that is discussed above with respect to FIG. 4.

As shown in FIG. 15, the printed circuit board 630 includes eight metal-plated apertures 650-1 through 650-8 that may each receive a respective one of the IDCs 170-1 through 170-8. The metal-plated apertures 650-1, 650-2, 650-7 and 650-8 on printed circuit board 630 are in the same locations as are metal-plated apertures 150-1, 150-2, 150-7 and 150-8 on printed circuit board 130, and hence will not be discussed further. However, metal plated apertures 650-3 through 650-6 are arranged in a "diamond pattern" in a central portion of the printed circuit board 630. This arrangement may be advantageous as the coupling between the IDCs if pairs 1 and 3 may then be "neutral" such that substantially no crosstalk is injected between the IDCs of pairs 1 and 3 because each IDC of pair 1 (e.g., IDC 170-4) will couple the same amount of energy onto the two IDCs of pair 3 (namely IDCs 170-3 and 170-6), and vice versa. In a first embodiment, all eight IDCs 170 may extend from the same side (e.g., the top) of the printed circuit board 630.

In other embodiments, the IDCs 170 for pairs 1 and 3 may be mounted to extend from a different side of the printed circuit board 630. For example, the IDCs 170-4, 170-5 for pair 1 could be mounted into metal-plated apertures 650-4 and 650-5 to extend above the top side of printed circuit board 630, and the IDCs 170-3, 170-6 for pair 3 could be mounted into metal-plated apertures 650-3 and 650-6 to extend below the bottom side of printed circuit board 630 (or vice versa), as is discussed above with reference to FIGS. 8A *and* 8B. This may facilitate routing the insulated conductors of the communications cable to the IDCs 170-3 through 170-6 of pairs 1 and 3 without generating extra crosstalk between pairs 1 and 3 that may otherwise be caused by the close proximity of the insulated conductors to each other or because of unbalanced coupling between the insulated conductors and the IDCs 170-3 through 170-6.

In yet another embodiment, a modified IDC 770 may be provided that could be used in the printed circuit board 130 of FIG. 4. This modified IDC 770 is illustrated in FIGS. 16A and 16B, which are a front view and a side view, respectively, of the IDC 770.

Figure 16A:
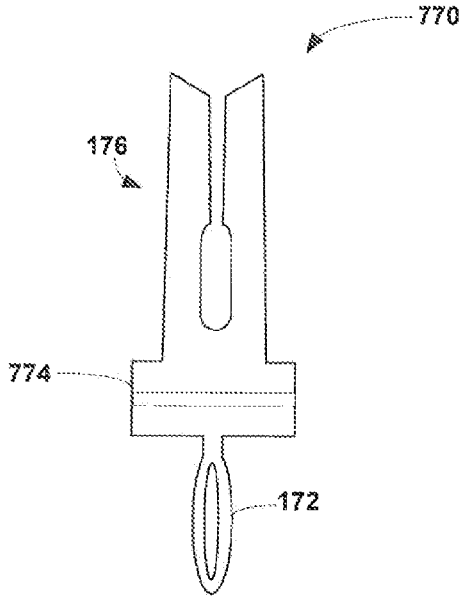
FIGS. 16A and 16B, are a front view and a side view, respectively, of an IDC according to further embodiments of the present invention.
Figure 16B:
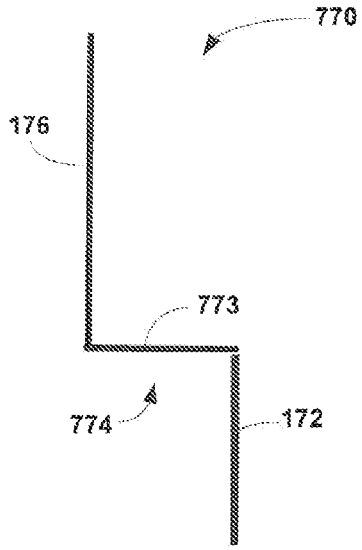

As shown in FIGS. 16A and 16B, the IDC 770 is very similar to the IDC 170 discussed above with reference to FIG. 6. However, the IDC 770 includes a transverse jog 773 in its central section 774 so that the base 172 and insulation displacement portion 176 are no longer collinear as is the case in the IDC 170 of FIG. 6. Because of this transverse jog 773, the IDCs 770-3 through 770-6 may be mounted in the metal-plated apertures 150-3 through 150-6 on printed circuit board 130, which are positioned more in a middle region of the board, yet the insulation displacement portions 176 of IDCs 770-3 and 770-6 may be positioned along the first and second side edges 133, 134 of printed circuit board 130.

Accordingly, in a jack according to further embodiments of the present invention, IDCs having the design of IDC 170 of FIG. 6 could be placed into the metal-plated apertures 150-1, 150-2, 150-7 and 150-8 of printed circuit board 130. Then, IDCs having the design of IDC 770 of FIGS. 16A and 16B could be placed into metal-plated apertures 150-3 through 150-6. The IDCs 770-3 and 770-6 would be positioned such that the transverse jog 773 in each IDC shifts the insulation displacement portions 176 of these IDCs closer to the side edge 133 of printed circuit board 130, and the IDCs 770-4, 770-5 would be positioned such that the transverse jog shifts the insulation displacement portions 176 of these IDCs closer to the side edge 134 of printed circuit board 130, This may allow the insulation displacement portions 176 of IDCs 170-1, 170-2, 770-3 and 770-6 to be longitudinally aligned, and would likewise allow the insulation displacement portions 176 of IDCs 770-4, 770-5, 170-7 and 170-8 to be longitudinally aligned. This design may provide additional room in the middle of the printed circuit board 130 for the insulated conductors of the communications cable, allowing the differential pairs of insulated conductors to be more separated, thereby reducing the crosstalk therebetween.

While embodiments of the present invention have primarily been discussed herein with respect to communications jacks that include eight conductive paths that are arranged as four differential pairs of conductive paths, it will be appreciated that the concepts described herein are equally applicable to jacks that include other numbers of differential pairs.

While the present invention has been described above primarily with reference to the accompanying drawings, it will be appreciated that the invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. As one specific example, various features of the communications jacks of the present invention are described as being, for example, on or above a top surface of a printed circuit board. It will be appreciated that if elements are on the bottom surface of a printed circuit board, they will be located on the top surface if the jack is rotated 180 degrees. Thus, the term "top surface" can refer to either the top surface or the bottom surface as the difference is a mere matter of orientation.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Herein, the terms "attached", "connected", "interconnected", "contacting", "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An RJ-45 communications jack, comprising:

a housing having a plug aperture;

first through eighth jackwire contacts, each of which has a plug contact region, the plug contact regions of the first through eighth jackwire contacts being aligned in numerical order across the plug aperture;

a printed circuit board;

first through eighth output contacts that intercept the printed circuit board at a first through eighth intercepts respectively;

wherein the printed circuit board has a front edge that extends toward an opening in the plug aperture, a rear edge opposite the front edge, and first and second side edges that extend between the front and rear edges, the printed circuit board including first and second conductive paths that are arranged as a second differential pair of conductive paths that electrically connect the first and second jackwire contacts to the respective first and second output contacts, seventh and eighth conductive paths that are arranged as a fourth differential pair of conductive paths that electrically connect the seventh and eighth jackwire contacts to the respective seventh and eighth output contacts, fourth and fifth conductive paths that are arranged as a first differential pair of conductive paths that electrically connect the fourth and fifth jackwire contacts to the respective fourth and fifth output contacts, and third and six conductive paths that are arranged as a third differential pair of conductive paths that electrically connect the third and sixth jackwire contacts to the respective third and sixth output contacts;

wherein the second differential pair of output contacts are positioned along the first side edge and the fourth differential pair of output contacts are positioned along the second side edge, generally opposite the second differential pair of output contacts, wherein the first differential pair of output contacts are positioned forward of the second and fourth differential pairs of output contacts, and the third differential pair of output contacts are positioned generally opposite the first differential pair of output contacts forward of the second and fourth differential pairs of output contacts, and wherein the first differential pair of output contacts is closer to the third differential pair of output contacts than the second differential pair of output contacts is to the fourth differential pair of output contacts.

2. The RJ-45 communications jack of claim 1, wherein the first and second conductive paths pass between both the first and third differential pairs of output contacts and the first side edge of the printed circuit board.

3. The RJ-45 communications jack of claim 1, wherein the seventh and eighth conductive paths pass between both the first and third differential pairs of output contacts and the second side edge of the printed circuit board.

4. The RJ-45 communications jack of claim 1, wherein the printed circuit board comprises a flexible printed circuit board.

5. The RJ-45 communications jack of claim 1, wherein the first through eighth output contacts comprise insulation displacement contacts.

6. The RJ-45 communications jack of claim 1, wherein the first and second conductive paths do not cross over any of the fourth through eighth conductive paths.

7. The RJ-45 communications jack of claim 1, wherein the seventh and eighth conductive paths do not cross over any of the first through fifth conductive paths.

8. The RJ-45 communications jack of claim 1, wherein at most only one of the first through eighth conductive paths crosses over a conductive path of a different differential pair of conductive paths.

9. The RJ-45 communications jack of claim 1, wherein the first, second, seventh and eighth conductive paths are longer than each of the third through sixth conductive paths.

10. The RJ-45 communications jack of claim 1, wherein a first straight line connecting the third intercept and the sixth intercept and a second straight line connecting the fourth intercept and the fifth intercept cross at an intersection point that lies between the third and sixth intercepts and between the fourth and fifth intercepts.

11. The RJ-45 communications jack of claim 10, wherein the intersection point is equidistant to the third and sixth intercepts and also equidistant to fourth and fifth intercepts.

12. The RJ-45 communications jack of claim 11, wherein the third and sixth output contacts extend from a first surface of the printed circuit board and the fourth and fifth output contacts extend from a second surface of the printed circuit board that is opposite to the first surface.

13. The RJ-45 communications jack of claim 5, wherein at least two of the insulation displacement contacts extend upwardly from a top surface of the printed circuit board, and at least two of the insulation displacement contacts extend downwardly from a bottom surface of the printed circuit board.

14. The RJ-45 communications jack of claim 4, wherein the flexible printed circuit board includes a fold that is positioned between the second and fourth differential pairs of output contacts and the first and third differential pairs of output contacts.

15. The RJ-45 communications jack of claim 4, wherein a crossover is provided on the flexible printed circuit board where a conductive path of one of the differential pairs of conductive paths crosses a conductive path of another of the differential pairs of conductive paths, wherein at least one of the conductive paths that forms the crossover has a narrowed width trace segment at the crossover.

16. A communications jack, comprising:

a plurality of input contacts;

a plurality of output contacts, the output contacts being arranged as a plurality of differential pairs of output contacts;

a flexible printed circuit board that includes a plurality of conductive paths that each electrically connect a respective one of the input contacts to a respective one of the output contacts, the conductive paths being arranged as a plurality of differential pairs of conductive paths;

wherein the flexible printed circuit board includes a fold of at least about 30 degrees, and wherein two of the differential pairs of output contacts are on a first side of the fold and two other of the differential pairs of output contacts are on the second side of the fold.

17. The communications jack of claim 16, wherein the communications jack is an RJ-45 communications jack.

18. The communications jack of claim 17, wherein the fold is between 60 and 120 degrees.

19. An RJ-45 communications jack, comprising:

a housing having a plug aperture;

first through eighth jackwire contacts, each of which has a plug contact region, the plug contact regions of the first through eighth jackwire contacts being aligned in numerical order across the plug aperture;

first through eighth output contacts;

a printed circuit board that has a front edge that extends toward an opening in the plug aperture, a rear edge opposite the front edge, and first and second side edges that extend between the front and rear edges, the printed circuit board including first and second conductive paths that are arranged as a second differential pair of conductive paths that electrically connect the first and second jackwire contacts to the respective first and second output contacts, seventh and eighth conductive paths that are arranged as a fourth differential pair of conductive paths that electrically connect the seventh and eighth jackwire contacts to the respective seventh and eighth output contacts, fourth and fifth conductive paths that are arranged as a first differential pair of conductive paths that electrically connect the fourth and fifth jackwire contacts to the respective fourth and fifth output contacts, and third and six conductive paths that are arranged as a third differential pair of conductive paths that electrically connect the third and sixth jackwire contacts to the respective third and sixth output contacts;

wherein the second differential pair of output contacts are positioned along the first side edge and the fourth differential pair of output contacts are positioned along the second side edge, generally opposite the second differential pair of output contacts, wherein the first differential pair of output contacts are positioned forward of the second and fourth differential pairs of output contacts, and wherein the first and third differential pairs of output contacts are arranged so that the first differential pair of output contacts imparts substantially no crosstalk on the third differential pair of output contacts.

20. The RJ-45 communications jack of claim 1, wherein the first and third differential pair of output contacts are arranged in a diamond-shaped pattern.

21. The RJ-45 communications jack of claim 1, wherein the first differential pair of output contacts is closer to the third differential pair of output contacts than the second differential pair of output contacts is to the fourth differential pair of output contacts.

* * * * *